US006179518B1

(12) United States Patent
Suatac

(10) Patent No.: US 6,179,518 B1
(45) Date of Patent: Jan. 30, 2001

(54) ADJUSTABLE MANHOLE COVER FRAME

(76) Inventor: Ismail Cemil Suatac, 2600 Draper Avenue, Apt. 1804, Ottawa, Ontario (CA), K2H 9A9

( * ) Notice: Under 35 U.S.C. 154(b), the term of this patent shall be extended for 0 days.

(21) Appl. No.: 09/247,914

(22) Filed: Feb. 11, 1999

(30) Foreign Application Priority Data

Feb. 11, 1998 (CA) ..... 2229380

(51) Int. Cl.[7] ..... E02D 29/14
(52) U.S. Cl. ..... 404/26
(58) Field of Search ..... 404/25, 26; 52/20

(56) References Cited

U.S. PATENT DOCUMENTS

| | | | | |
|---|---|---|---|---|
| 3,392,640 | * | 7/1968 | Zeile, Jr. | 404/25 |
| 3,533,199 | | 10/1970 | Pickett . | |
| 3,629,981 | | 12/1971 | McCaffrey . | |
| 3,858,998 | * | 1/1975 | Larsson et al. | 404/26 |
| 3,930,739 | | 1/1976 | Larsson et al. | 404/26 |
| 4,075,796 | | 2/1978 | Cuozzo | 52/20 |
| 4,145,151 | * | 3/1979 | Helms | 404/25 |
| 4,149,816 | | 4/1979 | Piso | 404/26 |
| 4,255,909 | * | 3/1981 | Soderstrom | 52/20 |
| 4,614,065 | * | 9/1986 | Papp | 52/20 |
| 4,906,128 | * | 3/1990 | Trudel | 404/26 |
| 4,925,337 | | 5/1990 | Spiess et al. | 404/26 |
| 5,095,667 | | 3/1992 | Ryan et al. | 52/20 |
| 5,344,253 | | 9/1994 | Sacchetti | 404/26 |
| 5,797,221 | * | 8/1998 | Young et al. | 52/20 |
| 5,974,741 | * | 11/1999 | Fukuhara | 52/20 |
| 6,007,270 | * | 12/1999 | Bowman | 404/25 |

FOREIGN PATENT DOCUMENTS 2208416 6/1997 (CA) .

* cited by examiner

*Primary Examiner*—Robert E. Pezzuto
*Assistant Examiner*—Kristine M. Markovich
(74) *Attorney, Agent, or Firm*—Thomas Adams

(57) ABSTRACT

An adjustable manhole cover frame suitable for mounting on a manhole basin has an outer ring, capable of resting on the top surface of the basin, and an inner ring engaging the outer ring by screw threads and having support for a manhole cover. The inner ring also has screw jacks having lower ends suitable for contacting the basin top and rotatable to lift the inner ring. The inner ring may be rotated within the outer ring to adjust the height of the manhole cover, and the screw jacks may be used both to stabilize the inner ring while the outer ring base remains close to or in contact with the top surface, and may also be used to lift both rings out of contact with the top surface when additional raising of the inner ring is required.

17 Claims, 5 Drawing Sheets

ADJUSTABLE MANHOLE COVER FRAME

BACKGROUND OF THE INVENTION

FIELD OF THE INVENTION

The present invention relates to a manhole cover frame for mounting a manhole cover above a manhole basin. The frame allows adjustment of the height of the manhole cover as necessitated by resurfacing a road surface and/or by frost heave of the surrounding ground.

Manhole basins, which may be a sewer basin having an inlet and an outlet, or may be a catchment basin having only an inlet, are normally cast of concrete. A frame of metal is fixed to the top of the basin and holds the manhole cover. In order to keep the cover level with a road or ground surface it is frequently necessary to alter the height between the manhole cover and the top of the basin, particularly in regions where there is much frost heave; adjustment to the height is usually done when a road is resurfaced.

Various constructions of adjustable manhole frames have been proposed to deal with the adjustment and to avoid replacing concrete parts. In some cases, screw jacks have been used between the annular frame which holds the cover and the top of the concrete manhole basin. In others, an outer ring, supported by the basin, has internal screw threads of large diameter within which is an inner ring having mating screw threads, and which is rotatable to adjust its height. Examples of patents showing such systems are:

U.S. Pat. No. 3,533,199, which issued Oct. 13, 1970 to Pickett;

U.S. Pat. No. 3,629,981, which issued Dec. 28, 1971 to McCaffrey;

U.S. Pat. No. 3,930,739, which issued Jan. 6, 1976 to Larsson et al.;

U.S. Pat. No. 4,075,796, which issued Feb. 28, 1978 to Cuozzo;

U.S. Pat. No. 4,149,816, which issued Apr. 17, 1979 to Piso;

U.S. Pat. No. 4,925,237, which issued May 15, 1990 to Spiess et al., and

U.S. Pat. No. 5,095,667, which issued Mar. 17, 1992 to Ryan et al.

These prior arrangements have some drawbacks. Where, as in the Pickett, McCaffrey, Cuozzo and Ryan et al. patents, reliance is placed on large diameter screw threads between outer and inner rings, these threads become worn and the manhole cover then starts to wobble as vehicles pass over, leading to more wear and possible breakage. The prior art systems using screw jacks have limited range of adjustability since screw jacks are likely to become unstable if extended too far.

SUMMARY OF THE INVENTION

The present invention seeks to overcome these deficiencies, and, to this end, provides a manhole cover frame in which the screw jacks are used to stabilize an inner ring which is connected to an outer ring by large diameter screw threads. This addresses the problem with wobble caused by wear of the large diameter screw threads. The outer ring can retain some contact with the top of the basin by means of a depending skirt and help to stabilize the frame, even when the jacks are considerably extended.

In accordance with the invention, an adjustable manhole cover frame suitable for mounting on an annular top surface of a manhole basin comprises:

an outer ring having a base capable of resting on the top surface and having internal screw threads;

an inner ring having external screw threads engaging the internal screw threads, and having support means for a manhole cover;

the inner ring carrying screw jacks having lower ends suitable for contacting the top surface and capable of being rotated to lift the inner ring;

whereby the inner ring may be rotated within the outer ring to adjust the height of the manhole cover support means;

and whereby the screw jacks may be used to stabilize the inner ring while the outer ring base remains in contact with the annular top surface, and may also be used to lift both rings out of contact with the annular top surface when additional raising of the inner ring is required.

In accordance with another feature of the invention, the outer ring has a depending skirt which overlaps with a generally cylindrical surface surrounding the annular top surface, which skirt limits intrusion of material between the outer ring and the annular top surface when the outer ring base is raised above the top surface. This means that the outer ring is itself telescopingly movable relative to the top of the basin. In this way the frame is provided, in effect, with two stages of telescoping movement, one between the annular top surface of the basin and the outer ring, and one between the outer and the inner rings. This large range of movement is effected by relative rotation of the outer and inner rings and by extension of the screw jacks; even when these jacks are fully extended the telescoping relationship of the parts allows the frame to be reasonably stable.

For good stability, the frame may have three screw jacks disposed substantially equidistantly, specifically at about 120°, around the interior of the inner ring, providing it with three point contact with the annular top surface.

Preferably, the outer ring has a series of recesses which allow the outer ring to be engaged by the surrounding soil and lifted with movement of that soil.

Protrusions, such as vertical ribs, may protrude from the exterior of the outer ring to engage the surrounding soil and prevent rotation of the outer ring with the inner ring when the latter is being rotated.

BRIEF DESCRIPTION OF THE DRAWINGS

A preferred embodiment of the invention will now be described by way of example with reference to the accompanying drawings, in which.

DETAILED DESCRIPTION

Figure 1:
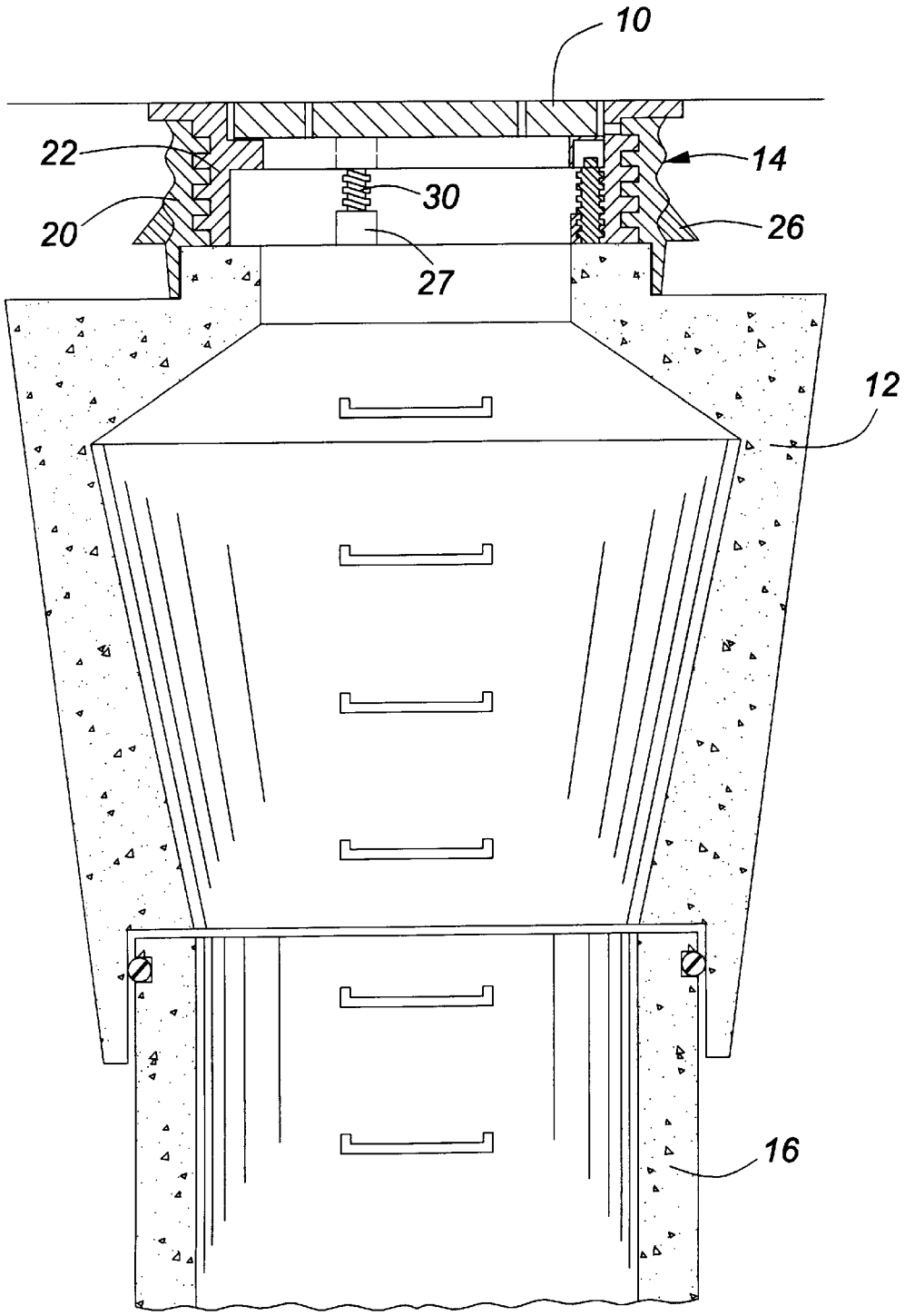
FIG. 1 is a sectional elevation of the upper part of a manhole basin having an adjustable manhole cover frame in accordance with the invention.

FIG. 1 shows a manhole cover 10 supported on the top section 12 of a manhole basin by an adjustable manhole cover frame 14 in accordance with this invention. The manhole basin of which the top section is shown in FIG. 1 is described in detail in my copending Canadian Pat. Application No. 2,208,416, filed Jun. 20, 1997. The basin is cast of concrete, and has a cylindrical middle section 16, the top portion of which is shown, and which rests on a lower section which is not shown but is preferably similar to that of my aforesaid patent application. The top section 12 rests telescopingly on the middle section, this top section 12 having a main upwardly diverging portion which allows this top section to be raised by the ground when this is lifted by frost heave, while the telescopic joint between the sections maintains a sealed connection between these. While this allows the top section 12 to stay near the ground level, the disturbances which occur near the ground mean that the manhole cover frame 14 nevertheless requires adjustability as provided by the present invention.

Figure 2:
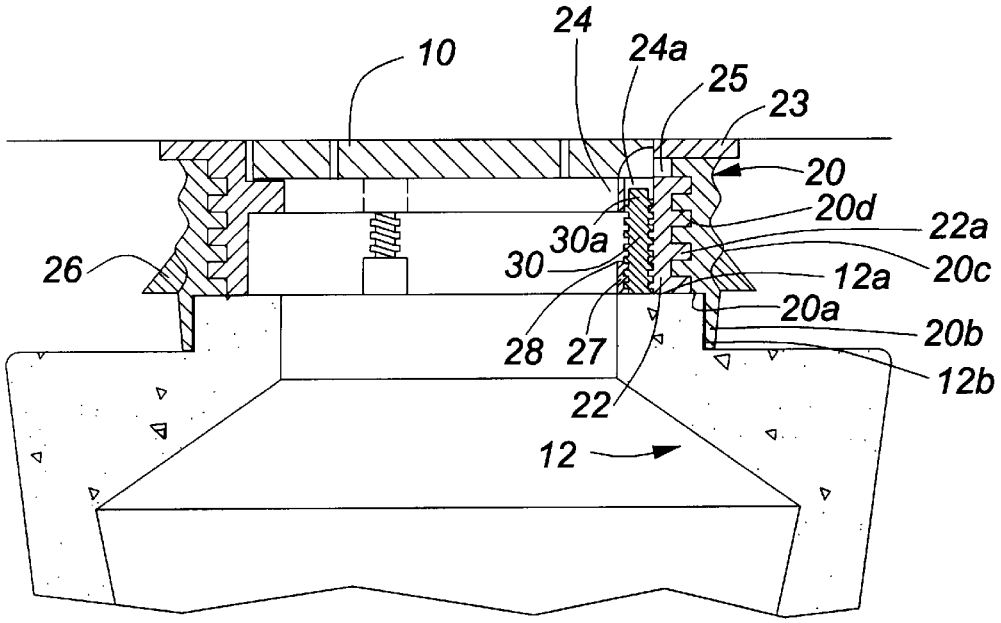
FIG. 2 is an enlarged sectional view of the frame in the same, retracted condition of FIG. 1.

As shown in more detail in FIG. 2, the top of the section 12 includes an annular top surface 12*a* surrounded by a generally cylindrical, but slightly upwardly tapering, outer surface 12*b*. The frame, which is formed of cast iron or other suitable metal, has an outer ring 20 with an annular base 20*a* resting on the top surface 12*a*, and has a depending skirt 20*b* which fits closely but slidingly against the outer surface 12*b*. While the ring 20 is generally cylindrical, it has a series of peripheral recesses 20*c* giving it a corrugated outer surface, which allows it to be gripped and raised by the surrounding soil. The internal surface of the ring 20 is provided with screw threads 20*d* of rectangular, and preferably square, profile. Rectangular or square profiles are preferred for both strength and lower effects of friction and wear. If desired, the threads of the inner/outer rings and/or the screw jacks could be coated with polyurethane or other suitable lubricant and hot deep galvanized to prevent rusting.

Figure 4:
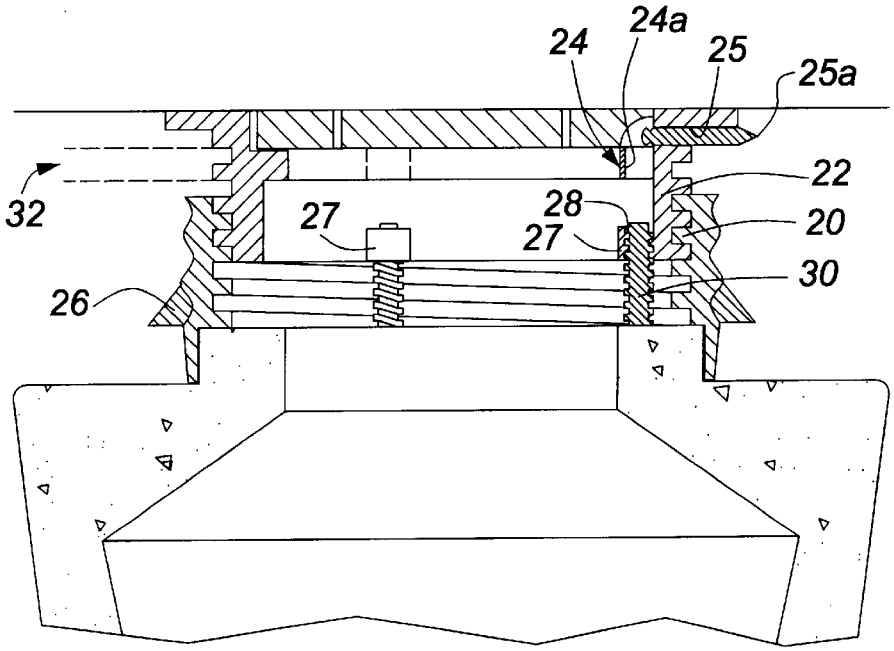
FIG. 4 is a similar view of the frame in a second expanded condition, after resurfacing of a surrounding road bed.

Engaging the threads 20*d* are external threads 22*a* of an inner ring 22. This has a lower end capable of being supported by the top surface 12*a*, and at its upper end has an outwardly directed flange 23. Near to the upper end is an inwardly directed flange 24, which acts as support means for the manhole cover 10. The top of flange 24 is recessed below the bottom of the flange 23 to allow space for a series of radial bores 25 (only one shown) which allow tools to be inserted into the inner ring to rotate this within the outer ring 20 and thus to adjust its height. After adjustment, pins 25*a* may be inserted through the bores 25 and into the surrounding soil to prevent further rotation. Such a pin 25*a* is shown in FIG. 4.

A series of triangular ribs or wings 26, typically four or more, protrude from the exterior of outer ring 20 to engage the surrounding soil and prevent rotation of the outer ring 20 with the inner ring 22 when the latter is being rotated.

The interior lower end of the inner ring 22 also has three bosses 27 equally spaced apart around its circumference, each having a vertical threaded bore 28, which engages the external threads of a screw jack 30. Each jack 30 has a lower end engaging the top surface 20*a*, and each has a square section 30*a* at its upper end engageable by a rotating tool such as a conventional socket wrench or key. The upper flange 24 has a series of holes 24*a* capable of accommodating the threads of the screw jacks, and which also allow access to the jacks by the rotating tool with the cover 10 removed. When rotated, the jacks 30 are capable of lifting both the inner and outer rings.

Although the three jacks spaced evenly around the frame at 120° from each other can ensure stability, more jacks could be used, if desired.

Operation of the manhole cover frame will now be described with reference to FIGS. 2–5.

FIG. 2 shows the minimum height, or initial collapsed condition, in which the bases of both the inner and outer rings are resting on the top surface 12*a* of the basin.

Figure 3:
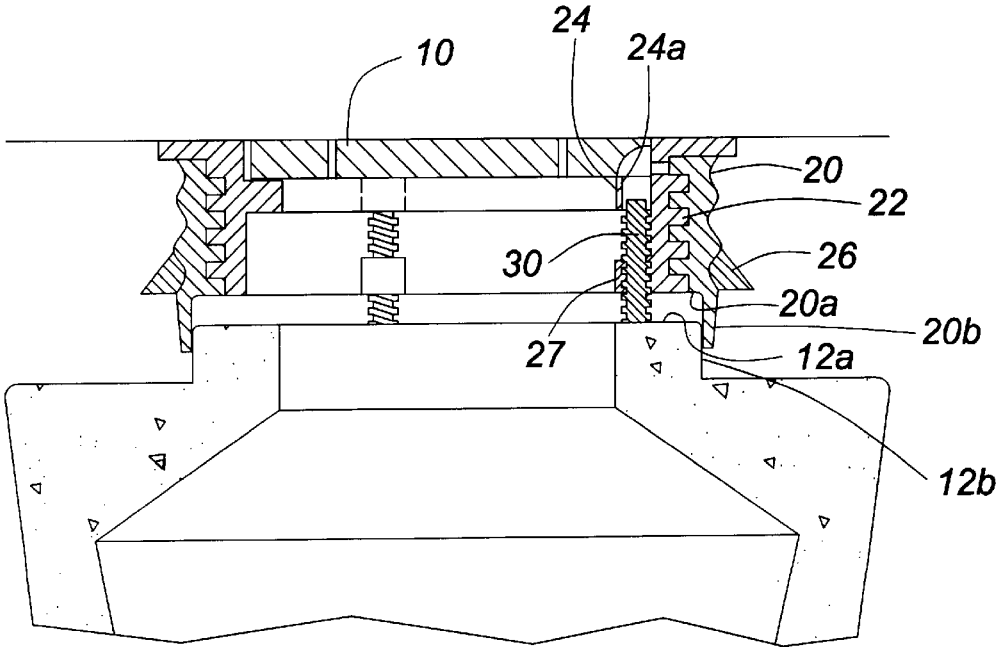
FIG. 3 is a similar view of the frame in a first expanded condition, after minor frost heave.

FIG. 3 shows the condition after a minor frost heave. This has lifted the outer ring 20, since the soil has gripped its corrugated outer surface, and with it the inner ring 22. However, the outer ring skirt 20*b* is still in contact with, or very close to, the outer surface 12*b* of the basin top, so that ingress of soil is prevented.

During the winter, the soil will be fairly solid and so will hold the outer ring 20 in the elevated position. In spring-time, after the frost has gone and the "heave" subsided, the manhole cover frame will settle towards the concrete surface 12*a*. At this time, the jacks 30 will be checked for tightness. If the jacks 30 are not sitting on the concrete surface 12*a*, i.e. because the manhole cover frame did not settle to its original position, the jacks 30 must be rotated into contact with the concrete surface 12*a* to eliminate/prevent rocking of the frame.

FIG. 4 shows the condition after a major resurfacing of the road, as indicated at 32, which has lifted its height above that of FIG. 3. The inner ring has been raised relative to the outer ring by rotating it with the tool inserted in bore 25, and subsequently the jacks 30 have been driven down into contact with the surface 12*a* and the pin 25*a* re-inserted. The use of the jacks 30 in this way ensures that the inner ring remains stable in spite of any wear or looseness between the threads of the outer and inner rings.

Figure 5:
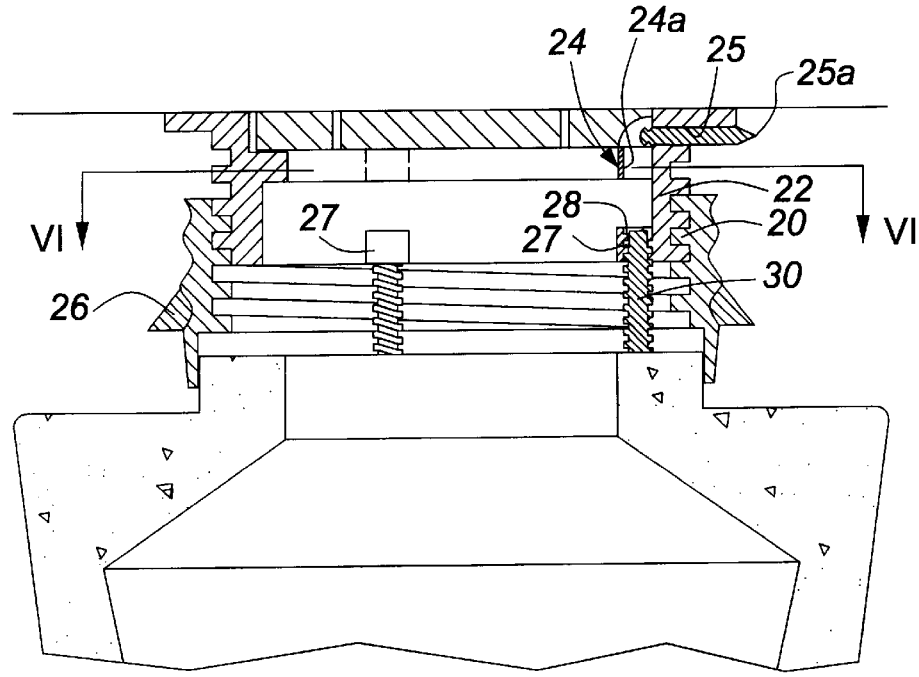
FIG. 5 is a view of the frame, after frost heave has followed the resurfacing illustrated in FIG. 4.
Figure 6:
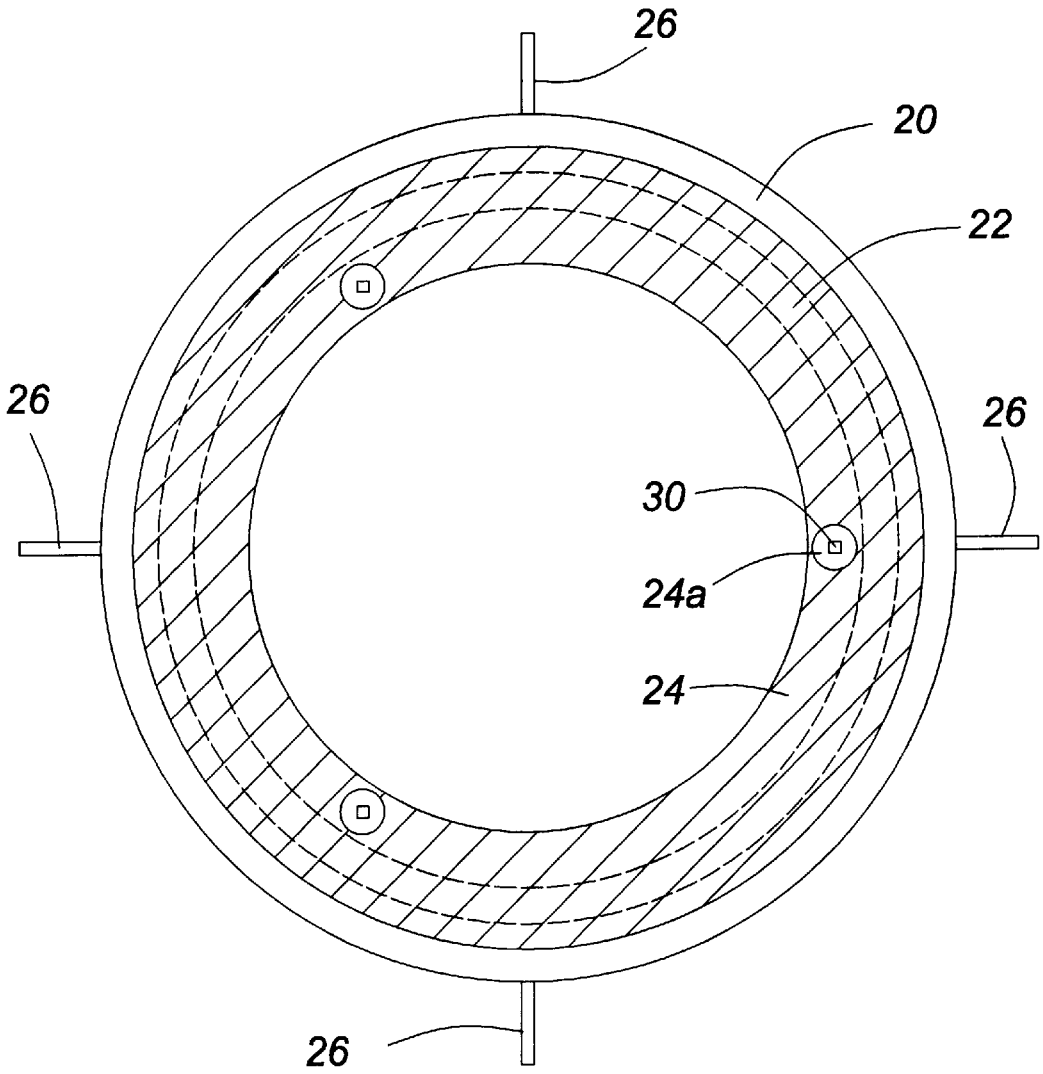
FIG. 6 is a cross-sectional plan view taken on the line VI—VI of FIG. 5.

FIG. 5 shows the condition subsequent to that of FIG. 4, when frost heave has again raised the outer ring out of contact with the surface 12*a*. As described with reference to FIG. 3, the jacks 30 would be checked in spring-time for looseness and tightened, as necessary, to eliminate/prevent rocking. Thus, FIG. 5 shows the manhole cover frame after adjustment of the inner ring 22 to compensate for road resurfacing and after spring-time adjustment of the jacks 30. It may be noted that, although the jacks 30 are fully extended, this condition is still reasonably stable because the outer ring skirt is still in contact with the outer basin surface 12*b*. This is made possible by the threaded connection between the inner and outer rings, and the presence of the skirt on the outer ring. This degree of stability could not be achieved with prior art constructions with jacks fully extended.

Whenever the inner ring 22 has been raised so that a gap is left between its lower surface and the top surface 12*a*, the gap may be filled by cement, concrete or other suitable material, providing it is relatively small, say up to 50 mm. The gap could be cleaned out if and when the inner ring 22 had to be lowered again.

It should be appreciated that the jacks 30 could be adjusted, during installation, to compensate for sloping of the road surface or tilting of the basin and ensure that the frame and cover are aligned with the road surface.

Figure 7:
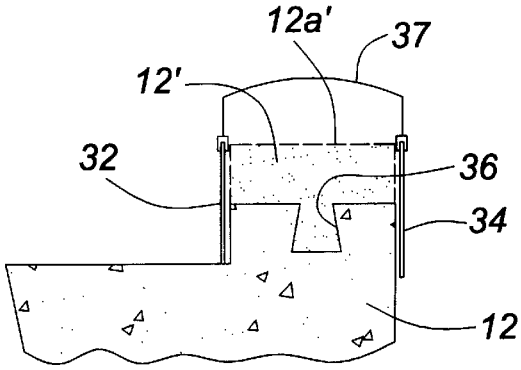
FIG. 7 is a detail cross-sectional view illustrating a modification.

The manhole basin may be installed so that surface 12*a* is actually lower than necessary, i.e. below the road surface by more than the depth of the frame, and a concrete extension cast onto it to extend top section 12 to the height and inclination required for the cover to be aligned with the road surface. Thus, as illustrated in FIG. 7, during installation top section 12 may be fitted with two tubular forms 32 and 34, inside and outside, respectively, and concrete poured between them to form a cylindrical extension 12' onto the top section 12. The top surface 12*a*' of extension 12' then replaces the top 12*a* of top section 12. A dovetail-shaped groove 36 in the upper surface of top section 12 receives the poured concrete to form a key for mechanical locking between the top section 12 and the extension 12' . The tubular forms 32 and 34 may be plastic, metal (e.g. stainless steel) fiberboard or other suitable material. Wire or plastic stays 37 provided at intervals around the forms 32 and 34 grip their respective upper edges and keep them at the required spacing during casting of the extension 12' .

Figure 8:
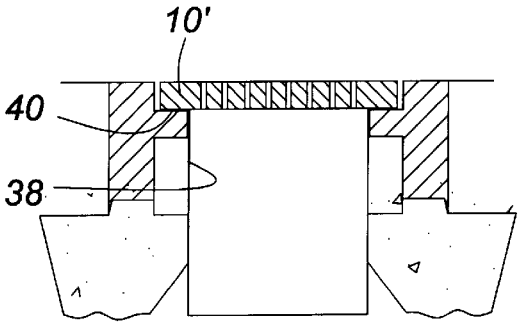
FIG. 8 is a detail cross-sectional view of a storm sewer manhole cover frame fitted with an internal plastic skirt.

In order to protect the adjustment jacks 30 from ingress of soil and dirt, a shield may be fitted inside the cover frame. Thus, FIG. 8 illustrates a modified manhole cover frame with a shield in the form of a cylindrical plastic skirt 38 which is similar in diameter to the internal diameter of top section 12 and the flange 24. The skirt 38 is supported by trapping its uppermost edge or rim portion 40 between the cover 10 and the flange 24. The skirt 38 hangs down within the frame to seal the annular space containing the jacks 30 against ingress of moisture and/or dirt passing through the cover 10' , which takes the form of a storm drain grating. To facilitate installation, the rim portion could be stiffened, perhaps by reinforcing it or attaching it to a flange or hoop which would be trapped beneath the cover.

Figure 9:
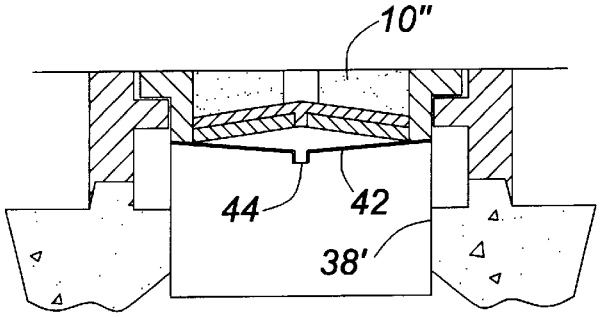
FIG. 9 is a detail cross-sectional view of a sanitary sewer manhole cover frame fitted with an internal plastic skirt.

FIG. 9 illustrates a similar modification for a sanitary sewer. The shield or skirt 38' is similar to the skirt 38 of FIG. 8, but for the sanitary sewer, the skirt 38' , has an additional radial cover portion 42 which extends inwardly from a position adjacent the lower edge of the manhole cover 10' . The radial portion 42 has a small vent 44 at its center.

It is also envisaged that an external shield could be provided to protect against ingress of moisture and/or soil, gravel, etc. into the screw threads 22*a* and 20*d* of the inner and outer rings 22 and 20, respectively. The external shield may comprise plastic tubing or sheet wrapped around the manhole cover frame, before the hole in which the frame is situated is backfilled with gravel etc.

Figure 10:
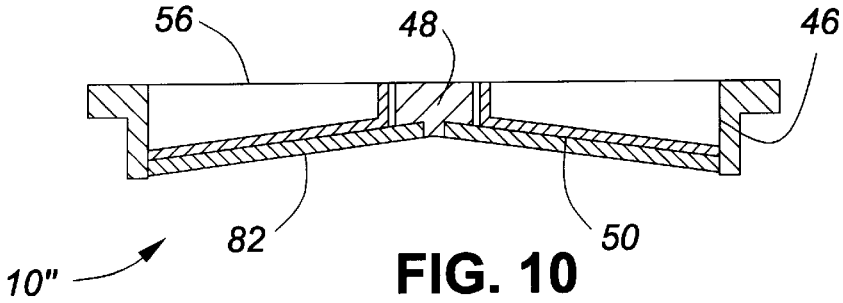
FIG. 10 is a cross-sectional view of a manhole cover for a sanitary sewer.

The sanitary sewer cover 10" of FIG. 9 is shown in more detail in FIG. 10. The cover 10" is generally dish-shaped with a peripheral rim 46, a central cylindrical boss 48, and a slightly conical bottom 50 reinforced by depending radial ribs 52. Holes 54 extend through the central boss 48 to serve as air vents. The holes 54 are slotted to permit insertion of lifting tools for lifting the cover. Either before or during application of the final layer of asphalt or other surfacing material, after the manhole and cover have been installed, the surfacing material will fill the dished cover 10" , as indicated at 56. This arrangement will reduce the rattling noise which usually occurs when vehicle tires pass over the manhole cover, both because the asphalt deadens the sound and because the usual studs of all-metal manhole covers are not required.

What is claimed is:

1. An adjustable manhole cover frame suitable for mounting on an annular top surface of a manhole basin, comprising:

an outer ring having a base capable of resting on said top surface and having internal screw threads;

an inner ring having external screw threads engaging said internal screw threads, and having support means for a manhole cover;

said inner ring carrying screw jacks having lower ends suitable for contacting said top surface and capable of being rotated to lift the inner ring;

whereby the inner ring may be rotated within the outer ring to adjust the height of the manhole cover support means, and whereby both screw jacks may be used both to stabilize the inner ring while the outer ring base remains close to, or in contact with, said top surface, and may also be used to lift both rings out of contact with said top surface when additional raising of the inner ring is required.

2. An adjustable manhole cover frame according to claim 1, wherein said outer ring has a depending skirt which overlaps with a generally cylindrical surface surrounding said annular top surface of the basin, which skirt limits intrusion of material between the outer ring and said top surface when the outer ring base is raised above said top surface.

3. An adjustable manhole cover frame according to claim 1, wherein said outer ring has a series of recesses which allow the outer ring to be engaged by the surrounding soil and lifted with movement of that soil.

4. An adjustable manhole cover frame according to claim 1, wherein said outer ring has a depending skirt which overlaps with a generally cylindrical surface surrounding said annular top surface of the basin, which skirt limits intrusion of material between the outer ring and said top surface when the outer ring base is raised above said top surface, and wherein said outer ring has a series of recesses which allow the outer ring to be engaged by the surrounding soil and lifted with movement of that soil.

5. An adjustable manhole cover frame according to claim 1, wherein said screw jacks each have a non-circular upper end arranged to be engaged by a rotating tool, said support means for the manhole cover allowing access to said upper ends when the manhole cover is removed.

6. An adjustable manhole cover frame according to claim 1, wherein said outer ring has a depending skirt which overlaps with a generally cylindrical surface surrounding said annular top surface of the basin, which skirt limits intrusion of material between the outer ring and said top surface when the outer ring base is raised above said top surface, and said screw jacks each have a non-circular upper end arranged to be engaged by a rotating tool, said support means for the manhole cover allowing access to said upper ends when the manhole cover is removed.

7. An adjustable manhole cover frame according to claim 1, wherein said screw threads have a rectangular profile.

8. An adjustable manhole cover frame according to claim 1, having three of said screw jacks disposed at about 120° around the interior of the inner ring, and providing said frame with three point contact with said top surface.

9. An adjustable manhole cover frame according to claim 1, wherein a plurality of protrusions extend outwardly from said outer ring so as to engage surrounding soil and prevent rotation of the outer ring when the inner ring is rotated.

10. An adjustable manhole cover frame according to claim 1, further comprising an internal shield member depending within the frame and shielding the screw jacks from moisture, dirt or other contaminants entering the manhole basin.

11. An adjustable manhole cover frame according to claim 1, further comprising an external shield member extending around the frame and shielding the internal screw threads and external screw threads of the outer ring and inner ring, respectively, from surrounding material.

12. An adjustable manhole cover frame according to claim 1, further comprising an internal shield member depending within the frame and shielding the screw jacks from moisture, dirt or other contaminants entering the manhole basin, and an external shield member extending around the frame and shielding the internal screw threads and external screw threads of the outer ring and inner ring, respectively, from surrounding material.

13. An adjustable manhole cover frame according to claim 1, further comprising an internal shield member depending within the frame and shielding the screw jacks from moisture, dirt or other contaminants entering the manhole basin, an external shield member extending around the frame and shielding the internal screw threads and external screw threads of the outer ring and inner ring, respectively, from surrounding material, and wherein a plurality of protrusions extend outwardly from said outer ring so as to engage surrounding soil and prevent rotation of the outer ring when the inner ring is rotated.

14. An adjustable manhole cover frame according to claim 1, wherein said outer ring has a depending skirt which overlaps with a generally cylindrical surface surrounding said annular top surface of the basin, said skirt limits intrusion of material between the outer ring and said top surface when the outer ring base is raised above said top surface, and said outer ring has a series of recesses which allow the outer ring to be engaged by the surrounding soil and lifted with movement of that soil.

15. An adjustable manhole cover frame according to claim 1, wherein said outer ring has a depending skirt which overlaps with a generally cylindrical surface surrounding said annular top surface of the basin, said skirt limits intrusion of material between the outer ring and said top surface when the outer ring base is raised above said top surface, and said outer ring has a series of recesses which allow the outer ring to be engaged by the surrounding soil and lifted with movement of that soil, and said screw jacks each have a non-circular upper end arranged to be engaged by a rotating tool, said support means for the manhole cover allowing access to said upper end when the manhole cover is removed.

16. An adjustable manhole cover frame according to claim 1, further comprising an internal shield member depending within the frame and shielding the screw jacks from moisture, dirt or other contaminants entering the manhole basin, and an external shield member extending around the frame and shielding the internal screw threads and external screw threads of the outer ring and inner ring, respectively, from surrounding material, and having three of said screw jacks disposed at about 120° around the interior of the inner ring, and providing said frame with three point contact with said upper surface.

17. An adjustable manhole cover frame according to claim 1, having three of said screw jacks disposed at about 120° around the interior of the inner ring, and providing said frame with three point contact with said upper surface, and an external shield member extending around the frame and shielding the internal screw threads and external screw threads of the outer ring and inner ring, respectively, from surrounding material.

* * * * *